US008875814B2

(12) United States Patent
Atkins et al.

(10) Patent No.: US 8,875,814 B2
(45) Date of Patent: Nov. 4, 2014

(54) ELEMENT CONTAINING THERMALLY STABLE POLYCRYSTALLINE DIAMOND MATERIAL AND METHODS AND ASSEMBLIES FOR FORMATION THEREOF

(75) Inventors: Brian Atkins, Houston, TX (US); Seth G. Anderle, Spring, TX (US); Robert W. Arfele, Magnolia, TX (US); Ram L. Ladi, Tomball, TX (US); Brandon Paul Linford, Draper, UT (US); Jason Keith Wiggins, Draper, UT (US); Kevin Duy Nguyen, Riverton, UT (US); Jiang Qian, Cedar Hills, UT (US); Kenneth Eugene Bertagnolli, Riverton, UT (US); Shawn Casey Scott, Payson, UT (US); Debkumar Mukhopadhyay, Sandy, UT (US); Michael Alexander Vail, Genola, UT (US)

(73) Assignee: Halliburton Energy Services, Inc., Houston, TX (US)

( * ) Notice: Subject to any disclaimer, the term of this patent is extended or adjusted under 35 U.S.C. 154(b) by 52 days.

(21) Appl. No.: 13/457,009

(22) Filed: Apr. 26, 2012

(65) Prior Publication Data

US 2013/0056284 A1 Mar. 7, 2013

Related U.S. Application Data

(63) Continuation of application No. 13/225,134, filed on Sep. 2, 2011, now Pat. No. 8,261,858.

(51) Int. Cl.
*E21B 10/46* (2006.01)
*E21B 10/573* (2006.01)

(52) U.S. Cl.
CPC ..... *E21B 10/5735* (2013.01)
USPC ..... 175/434

(58) Field of Classification Search
USPC ..... 175/374, 405.1, 420.2, 425, 434
See application file for complete search history.

(56) References Cited

U.S. PATENT DOCUMENTS

| | | | | |
|---|---|---|---|---|
| 3,147,542 | A | 9/1964 | Boeckeler | |
| 4,224,380 | A | 9/1980 | Bovenkerk et al. | 428/545 |
| 4,602,691 | A | 7/1986 | Weaver | 175/329 |

(Continued)

FOREIGN PATENT DOCUMENTS

| | | |
|---|---|---|
| GB | 2447776 | 9/2008 |
| GB | 2463975 | 4/2010 |

(Continued)

OTHER PUBLICATIONS

International Search Report and Written Opinion; Application No. PCT/US2012/041778, pp. 16, Dec. 17, 2012.

(Continued)

*Primary Examiner* — Brad Harcourt
(74) *Attorney, Agent, or Firm* — Baker Botts L.L.P.

(57) ABSTRACT

The disclosure provides a super abrasive element containing a substantially catalyst-free thermally stable polycrystalline diamond (TSP) body having pores and a contact surface, a base adjacent the contact surface of the TSP body; and an infiltrant material infiltrated in the base and in the pores of the TSP body at the contact surface. The disclosure additionally provides earth-boring drill bits and other devices containing such super abrasive elements. The disclosure further provides methods and mold assemblies for forming such super abrasive elements via infiltration and hot press methods.

38 Claims, 5 Drawing Sheets

(56) References Cited

U.S. PATENT DOCUMENTS

| | | | | |
|---|---|---|---|---|
| 4,629,373 | A | 12/1986 | Hall | 407/118 |
| 4,850,523 | A | 7/1989 | Slutz | 228/121 |
| 5,120,327 | A | 6/1992 | Dennis | 51/293 |
| 5,238,074 | A | 8/1993 | Tibbitts et al. | 175/428 |
| 5,492,188 | A | 2/1996 | Smith et al. | 175/432 |
| 6,510,906 | B1 | 1/2003 | Richert et al. | 175/39 |
| 6,544,308 | B2 | 4/2003 | Griffin et al. | 51/309 |
| 6,843,333 | B2 | 1/2005 | Richert et al. | 175/379 |
| 7,234,550 | B2 | 6/2007 | Azar et al. | 175/432 |
| 7,469,757 | B2 | 12/2008 | Azar et al. | 175/432 |
| 7,487,849 | B2 | 2/2009 | Radtke | 175/434 |
| 7,533,740 | B2 | 5/2009 | Zhang et al. | 175/432 |
| 7,712,553 | B2 | 5/2010 | Shamburger | 175/374 |
| 7,730,976 | B2 | 6/2010 | McClain et al. | 175/431 |
| 7,845,438 | B1 | 12/2010 | Vail et al. | 175/434 |
| 2006/0060392 | A1 | 3/2006 | Eyre | 175/434 |
| 2007/0082229 | A1 * | 4/2007 | Mirchandani et al. | 428/698 |
| 2008/0066969 | A1 * | 3/2008 | Paul-Philippe | 175/405.1 |
| 2008/0230280 | A1 * | 9/2008 | Keshavan et al. | 175/434 |
| 2010/0282519 | A1 | 11/2010 | Zhang et al. | |
| 2011/0024201 | A1 * | 2/2011 | Scott et al. | 175/428 |
| 2011/0030283 | A1 | 2/2011 | Cariveau et al. | |

FOREIGN PATENT DOCUMENTS

| | | | |
|---|---|---|---|
| WO | WO 99/28589 | 6/1999 | E21B 10/48 |
| WO | 2010/129811 A2 | 11/2010 | |
| WO | 2012/121946 A2 | 9/2012 | |

OTHER PUBLICATIONS

Bundy et al.. "Diamond-Graphite Equilibrium Line from Growth and Graphitization of Diamond," *J. of Chemical Physics*, 35(2):383-391, 1961.

Kennedy et al., "The Equilibrium Boundary Between Graphite and Diamond," *J. of Geophysical Res*., 81(14): 2467-2470, 1976.

Bundy, et al., "The Pressure-Temperature Phase and Transformation Diagram for Carbon; Updated through 1994," *Carbon* 34 (2): 141-153, 1996.

International Preliminary Report on Patentability; PCT/US2012/041778; pp. 12, Dec. 27, 2013.

* cited by examiner

ELEMENT CONTAINING THERMALLY STABLE POLYCRYSTALLINE DIAMOND MATERIAL AND METHODS AND ASSEMBLIES FOR FORMATION THEREOF

RELATED APPLICATIONS

This application is a Continuation of U.S. patent application Ser. No. 13/225,134 filed Sep. 2, 2011 now U.S. Pat. No. 8,261,858, the contents which is incorporated herein in its entirety by this reference.

TECHNICAL FIELD

The current disclosure relates to a super abrasive element containing a super-abrasive body, such as a thermally stable polycrystalline diamond (TSP) body, bonded to a base via an infiltrant material. In more specific embodiments, the TSP body may substantially free of infiltrant material, with only a small amount present near the TSP body surface in contact with the base. In some embodiments, the infiltrant material may also permeate the base, where if may function as a binder. The current disclosure also relates to methods of forming a super abrasive element containing a TSP body bonded to a base using an infiltrant material. In particular embodiments, the method may include forming a super abrasive element by forming the base in a mold also containing the TSP in the presence of the infiltrant material.

BACKGROUND

Components of various industrial devices are often subjected to extreme conditions, such as high impact contact with abrasive surfaces. For example, such extreme conditions are commonly encountered during subterranean drilling for oil extraction or mining purposes. Diamond, with its unsurpassed wear resistance, is the most effective material for earth drilling and similar activities that subject components to extreme conditions. Diamond is exceptionally hard, conducts heat away from the point of contact with the abrasive surface, and may provide other benefits in such conditions.

Diamond in its polycrystalline form has added toughness as compared to single crystal diamond due to the random distribution of the diamond crystals, which avoids the particular planes of cleavage found in single diamond crystals. Therefore, polycrystalline diamond is frequently the preferred form of diamond in many drilling applications or other extreme conditions. Device elements have a longer usable life in these conditions if their surface layer is made of diamond, typically in the form of a polycrystalline diamond (PCD) compact, or another super abrasive material.

Elements for use in harsh conditions may contain a PCD layer bonded to a substrate. The manufacturing process for a traditional PCD is very exacting and expensive. The process is referred to as "growing" polycrystalline diamond directly onto a carbide substrate to form a polycrystalline diamond composite compact. The process involves placing a cemented carbide piece and diamond grains mixed with a catalyst binder into a container of a press and subjecting it to a press cycle using ultrahigh pressure and temperature conditions. The ultrahigh temperature and pressure are required for the small diamond grains to form into an integral polycrystalline diamond body. The resulting polycrystalline diamond body is also intimately bonded to the carbide piece, resulting in a composite compact in the form of a layer of polycrystalline diamond intimately bonded to a carbide substrate.

A problem with PCD arises from the use of cobalt or other metal catalyst/binder systems to facilitate polycrystalline diamond growth. After crystalline growth is complete, the catalyst/binder remains within pores of the polycrystalline diamond body. Because cobalt or other metal catalyst/binders have a higher coefficient of thermal expansion than diamond, when the composite compact is heated, e.g., during the brazing process by which the carbide portion is attached to another material, or during actual use, the metal catalyst/binder expands at a higher rate than the diamond. As a result, when the PCD is subjected to temperatures above a critical level, the expanding catalyst/binder causes fractures throughout the polycrystalline diamond structure. These fractures weaken the PCD and can ultimately lead to damage to or failure.

As a result of these or other effects, it common to remove the catalyst from part of the PCD layer, particularly the parts near the working surface. The most common process for catalyst removal uses a strong acid bath, although other processes that employ alternative acids or electrolytic and liquid metal techniques also exist. In general, removal of the catalyst from the PCD layer using an acid-based method is referred to as leaching. Acid-based leaching typically occurs first at the outer surface of the PCD layer and proceeds inward. Thus, traditional elements containing a leached PCD layer are often characterized as being leached to a certain depth from their surface. PCD, including regions of the PCD layer, from which a substantial portion of the catalyst has been leached is referred to as thermally stable PCD (TSP). Examples of current leaching methods are provided in U.S. Pat. No. 4,224,380; U.S. Pat. No. 7,712,553; U.S. Pat. No. 6,544,308; U.S. 20060060392 and related patents or applications.

Acid-leaching leaching must also be controlled to avoid contact between substrate or the interface between the substrate and the diamond layer and the acids used for leaching. Acids sufficient to leach polycrystalline diamond severely degrade the much less resistant substrate. Damage to the substrate undermines the physical integrity of the PCD element and may cause it to crack, fall apart, or suffer other physical failure while in use, which may also cause other damage.

The need to carefully control leaching of elements containing a PCD layer significantly adds to the complications, time, and expense of PCD manufacturing. Additionally, leaching is typically performed on batches of PCD elements. Testing to ensure proper leaching is destructive and must be performed on a representative element from each batch. This requirement for destructive testing further adds to PCD element manufacturing costs.

Attempts have been made to avoid the problems of leaching a fully formed element by separately leaching a PCD layer, then attaching it to a substrate. However, these attempts have failed to produce usable elements. In particular, the methods of attaching the PCD layer to the substrate have failed during actual use, allowing the PCD layer to slip or detach. In particular, elements produced using brazing methods, such as those described in U.S. Pat. No. 4,850,523; U.S. Pat. No. 7,487,849, and related patents or applications, or mechanical locking methods such as those described in U.S. Pat. No. 7,533,740 or U.S. Pat. No. 4,629,373 and related patents or applications are prone to failure.

Other methods of bonding a PCD layer to a pre-formed substrate are described in U.S. Pat. No. 7,845,438, but require melting of a material already present in the substrate and infiltration of the PCD layer by the material.

In still other methods, leached PCD layers have been attached directly to the gage region of a bit by infiltrating the entire bit and at least a portion of the PCD layer with a binder material. Although these methods are suitable to attaching PCD to a gage region, where it need not be removed during the lifetime of the bit, they are not suitable for placing PCD layers in the cutting regions of a bit, where replacement or rotation of the PCD is desirable for providing normal bit life.

Using still other methods, PCD elements, often referred to as geosets, have been incorporated into the exterior portions of drill bits. Geosets are typically coated with a metal, such as nickel (Ni). Geoset coatings may provide various benefits, such as protection of the diamond at higher temperature and improved bonding to the drill bit matrix.

Accordingly, a need exists for an element, including a rotatable or replaceable element, having a leached PCD layer, such as a TSP body, attached to a base or substrate sufficiently well to allow use of the element in high temperature conditions such as those encountered by cutting elements of an earth-boring drill bit.

SUMMARY

The disclosure, according to one embodiment, provides a super abrasive element containing a substantially catalyst-free thermally stable polycrystalline diamond (TSP) body having pores and a contact surface, a base adjacent the contact surface of the TSP body; and an infiltrant material infiltrated in the base and in the pores of the TSP body at the contact surface.

According to another embodiment, the disclosure provides an earth-boring drill bit containing such a super abrasive element in the form of a cutter.

According to still another embodiment, the disclosure provides an assembly for forming a super abrasive element including a mold having a bottom, a thermally stable polycrystalline diamond (TSP) body having a contact surface and located in the bottom of the mold, a matrix powder disposed adjacent the contact surface and above the TSP body in the mold, and an infiltrant material disposed above the matrix powder in the mold.

According to a further embodiment, the disclosure provides an assembly for forming a super abrasive element including a mold, a thermally stable polycrystalline diamond (TSP) body having a contact surface and located in the mold, a matrix powder disposed adjacent the contact surface in the mold, and an infiltrant or binder material disposed in the matrix powder in the mold.

The disclosure additionally provides a method of forming a super abrasive by assembling an assembly including a mold having a bottom, a thermally stable polycrystalline diamond (TSP) body having pores and a contact surface and located in the bottom of the mold, a matrix powder disposed adjacent the contact surface and above the TSP body in the mold, and an infiltrant material disposed above the matrix powder in the mold. The method further includes heating the assembly to a temperature and for a time sufficient for the infiltrant material to infiltrate the matrix powder and pores of the TSP body, and cooling the assembly to form a super abrasive element.

The disclosure further provides an additional method of forming a super abrasive element including assembling an assembly including a mold, a thermally stable polycrystalline diamond (TSP) body having pores and a contact surface and located in the mold, a matrix powder disposed adjacent the contact surface in the mold, and an infiltrant or binder material disposed in the matrix powder. The method also includes heating the assembly to a temperature and pressure and for a time sufficient for the infiltrant or binder material to infiltrate the matrix powder to form a base attached to the TSP body.

BRIEF DESCRIPTION OF THE DRAWINGS

A more complete understanding of the present embodiments and advantages thereof may be acquired by referring to the following description taken in conjunction with the accompanying drawings, which depict embodiments of the present disclosure, and in which like numbers refer to similar components, and in which.

DETAILED DESCRIPTION

The current disclosure relates to a super abrasive element containing a super abrasive body, such as a thermally stable polycrystalline diamond (TSP) body bound to a base via an infiltrant material. The disclosure also relates to tools containing such super abrasive elements as well as methods of making such super abrasive elements. In general, during methods of making super abrasive elements, the super abrasive properties of the super abrasive body, such as a TSP body, may remain substantially unchanged or undeteriorated.

Although in the example embodiments described herein, superabrasive elements are in a generally cylindrical shape with a flat surface, they may be formed in any shape suitable for their ultimate use, such as, in some embodiments, a conical shape, a variation of a cylindrical shape, or even with angles. Additionally, the surface of the superabrasive elements in some embodiments may be concave, convex, or irregular.

Figure 1:
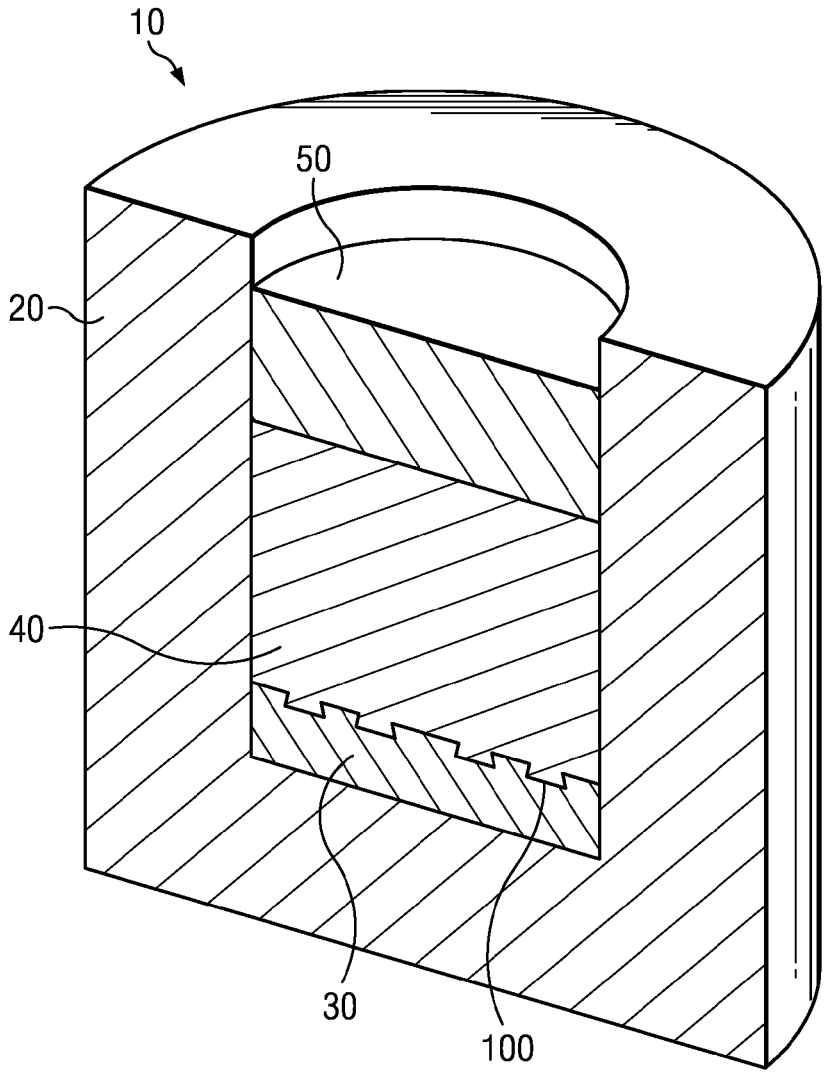
FIG. 1 is a cross-sectional side view of an infiltration method assembly for forming a super abrasive element containing a TSP body bonded to a base via an infiltrant material.

An assembly 10, as shown in FIG. 1, may be provided for use in forming a super abrasive element via an infiltration method. Assembly 10 may include mold 20 intended to contain the components of the super abrasive element while it is being formed. TSP body 30 may be disposed within mold 20. TSP body 30 may substantially lack catalyst used in forming the body. For instance, at least 85% of the catalyst may be removed from the body. Matrix powder 40 may also be disposed within mold 20 on top of TSP body 30. Finally, infiltrant material 50 may be disposed within mold 20 on top of matrix powder 40.

Figure 2:
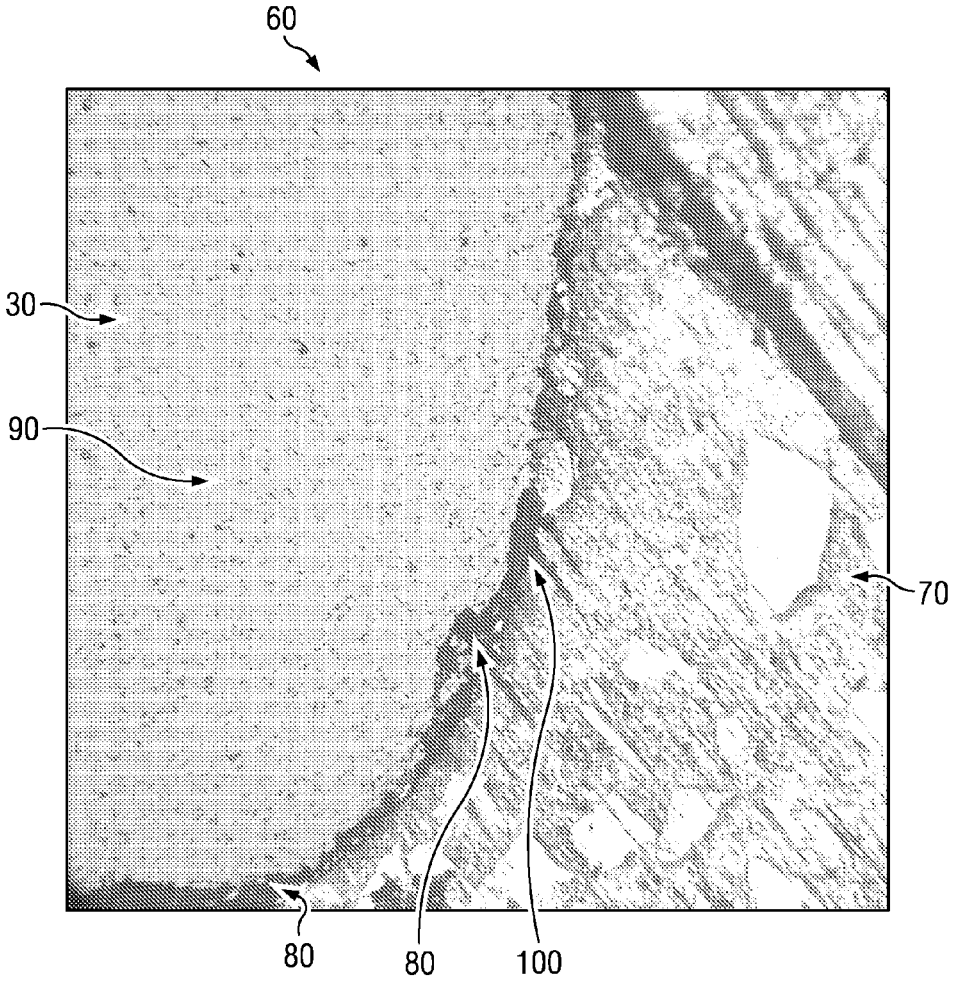
FIG. 2 is a magnified cross-sectional view of a super abrasive element.

To form a super abrasive element, assembly 10 may be subjected to a formation process during which matrix powder 40 is infiltrated by infiltrant material 50, which functions as a binder, and eventually forms a base. Infiltrant material 50 wets the surface of TSP body 30 in contact with matrix powder 40 and fills pores in TSP body 30 at the surface, attaching TSP body 30 to the base. FIG. 2 shows a magnified image of a cross-section of a super abrasive element 60 that may be formed. Super abrasive element 60 includes the TSP body 30 bound to a base 70 that is formed from the matrix powder 40. In a particular embodiment, infiltrant material 50 may be dispersed within base 70 as a binder and also infiltrate pores in the contact surface 100 of TSP body 30, which is in contact with base 70, to a depth of D to form infiltrant material-containing region 80. The remainder of TSP body 30 may substantially lack binder and may form infiltrant-free region 90. Pores may be engineered to allow the formation of a micromechanical bond between the base and the TSP rather than merely a metallurgical bond.

According to another embodiment (not shown) infiltrant material 50 may be intermixed with matrix powder 40 prior to the formation process. In such an embodiment, infiltrant material nevertheless infiltrates matrix powder 40 and wets the surface of TSP body 30, also filling in pores on that surface, to allow attachment of base 70 formed from matrix powder 40 to TSP body 30.

Figure 3:
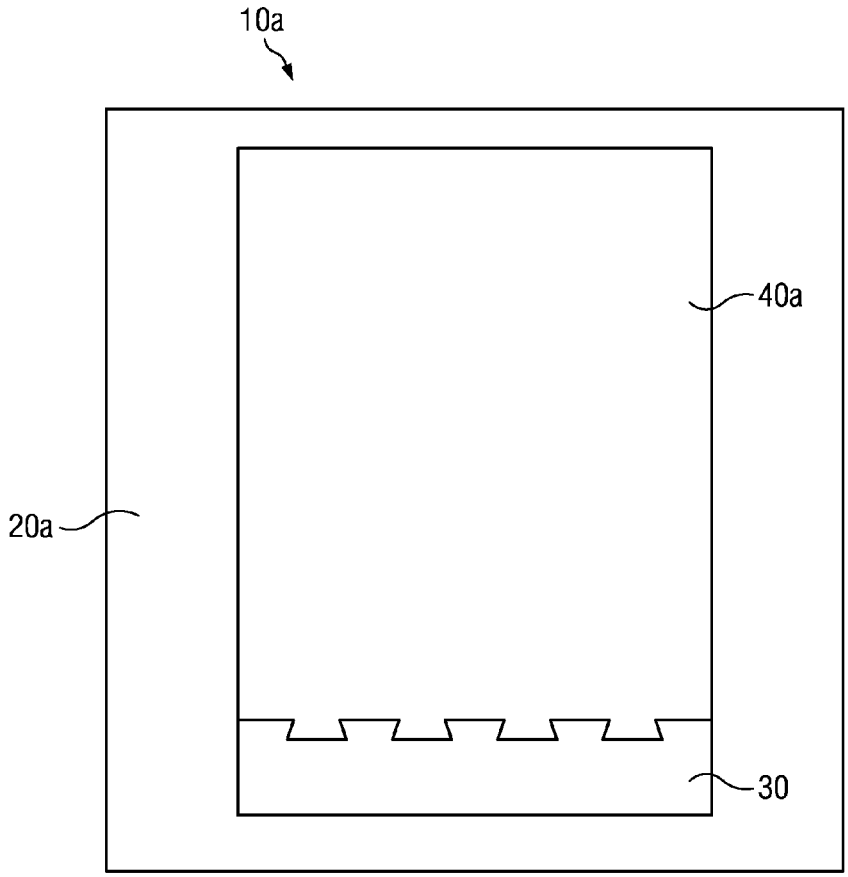
FIG. 3 is a cross-sectional side view of a hot press method assembly for forming a super abrasive element containing a TSP body bonded to a base via an infiltrant material.

According to a further embodiment shown in FIG. 3, a superabrasive element 60 of the type depicted in FIG. 2 may be formed using an assembly 10*a* and a hot press method. Assembly 10*a* may include mold 20*a* intended to contain the components of the super abrasive element while it is being formed. TSP body 30 may be disposed within mold 20*a*. Matrix powder 40*a* may be disposed within mold 20*a* as well. Typically when using a hot press method, an infiltrant material is intermixed with the matrix powder prior to hot pressing. Accordingly, matrix powder 40*a* may additionally contain a binder material intermixed therein. The binder material may be an infiltrant material, or it may be a material not able to infiltrate TSP body 30. In instances where the binder material cannot infiltrate TSP body 30, or cannot do so sufficiently to attach it to base 70 after formation of the super abrasive element, TSP body 30 may be attached to base 70 primarily by mechanical forces resulting from the use of a hot press methodology. In other hot press embodiments, a disc of infiltrant material 50 may be placed on the matrix powder 40 and used to infiltrate the matrix powder, for instance under lower pressure.

In alternative embodiments, other infiltration methods, such as hot isostatic pressing, may be used to infiltrate the matrix powder with infiltrant material.

Mold 20 used in assembly 10 may be made of any material suitable to withstand the formation process and allow removal of the super abrasive element formed. According to a particular embodiment, mold 20 may contain a ceramic material. Although mold 20 is shown with a flat bottom, in certain embodiments (not shown) it may be shaped to allow infiltrant material 50 to flow around the sides of TSP body 30, assisting in mechanical attachment of TSP body 30 to base 70. Mold 20*a* may be any mold suitable to withstand a hot press cycle.

Figure 4:
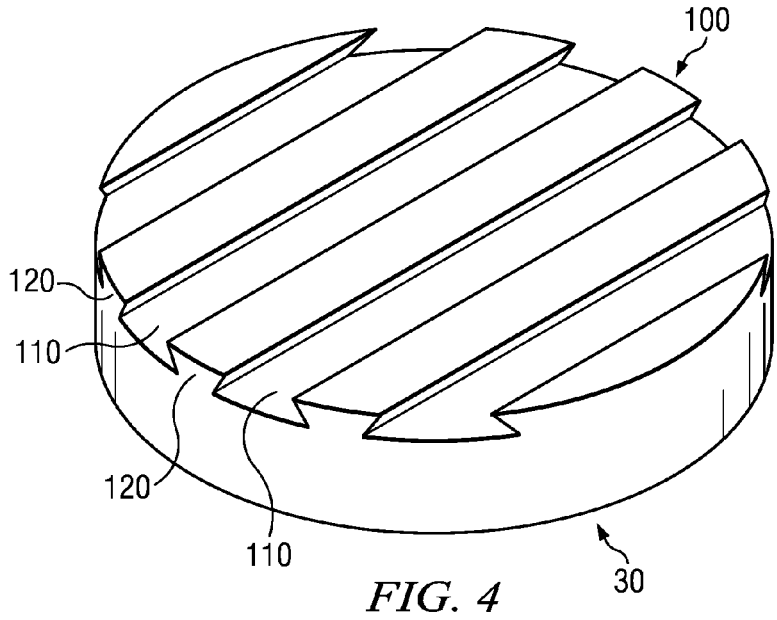
FIG. 4 is a side view of a TSP body for use in one embodiment of the present disclosure.

TSP body 30 may be in any shape suitable for use in super abrasive element 60. In some embodiments, it may be in the form of a disk, as shown in FIG. 4. TSP body 30 may have a substantially planar contact surface (not shown). However, as shown in FIG. 4, TSP body 30 may have features to mechanically enhance its attachment to base 70 in the super abrasive element 60. In particular, TSP body 30 may have a non-planar contact surface 100 like that shown in FIG. 4. The non-planar contact surface 100 may contain non-planar features, such as grooves 110. Grooves 110 may help prevent TSP body 30 from slipping from base 70 in response to a force applied at a right angle to the grooves. The non-planar contact surface 100 may have angled regions, such as angled walls 120 of grooves 110. These angled walls 120 may improve the mechanical connection between TSP body 30 and base 70 by interlocking the two components.

Figure 5A:
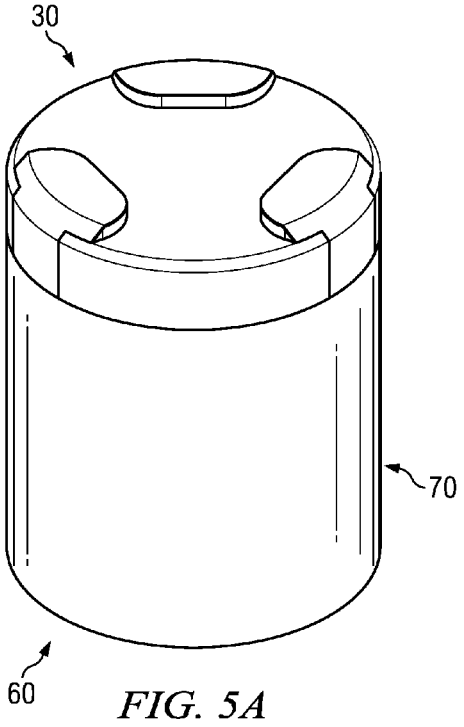
FIGS. 5A and 5B are top and side views of super abrasive elements.
Figure 5B:
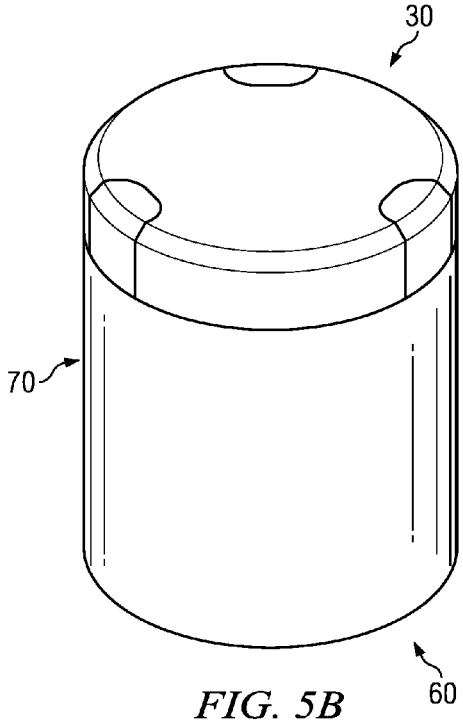
Figure 7:
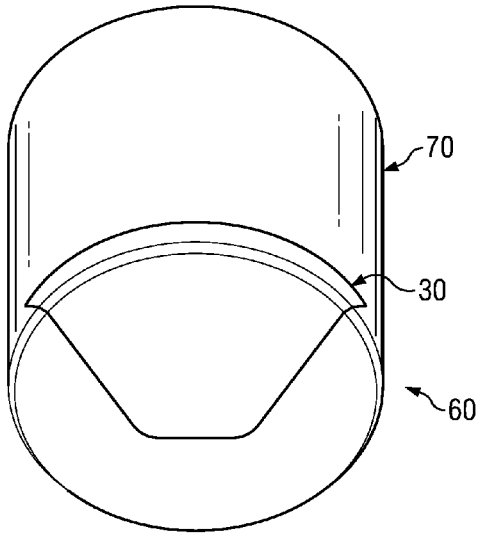
FIG. 7 is a side view of a super abrasive element having a dovetail lock.
Figure 8:
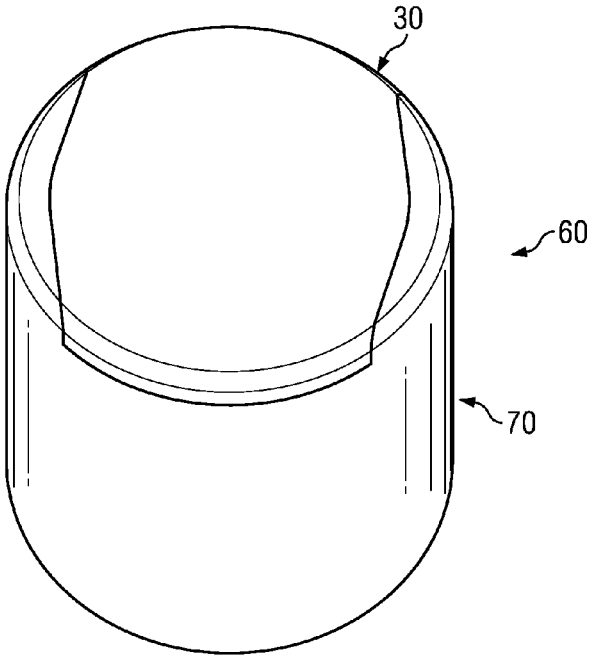
FIG. 8 is a side view of a super abrasive element having a lateral lock.
Figure 9:
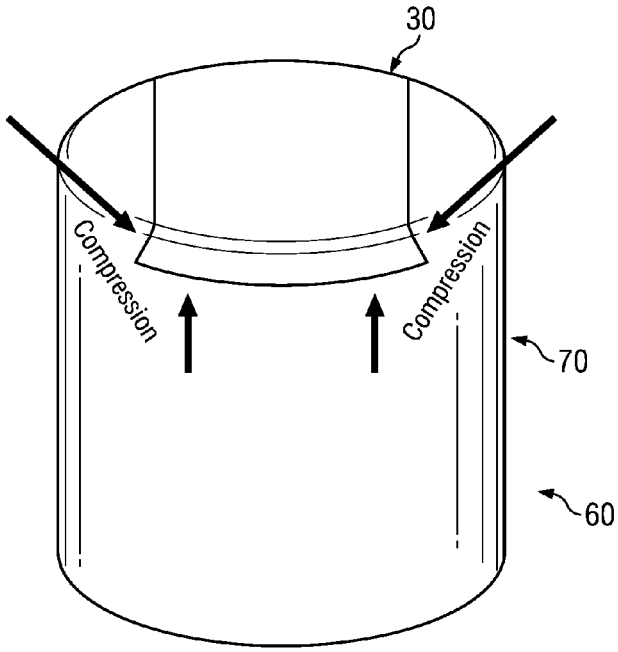
FIG. 9 is a side view of a super abrasive element having a combined dovetail and lateral lock.

Additional configurations to increase the mechanical attachment of TSP body 30 to base 70 may also be used. Two examples of such configuration are shown in FIGS. 5A and 5B. Further mechanical attachments mechanisms may include prior mechanical TSP attachment mechanisms that proved unsuitable when used alone may be suitable when combined with attachment via infiltrant material 50 and may actually improve the overall attachments of TSP body 30 to base 70. Example mechanisms include those found in U.S. Pat. No. 7,533,740 or U.S. Pat. No. 4,629,373, incorporated by reference herein. Other configurations that may increase mechanical attachment of TSP body 30 to base 70 are shown in FIGS. 7, 8 and 9. Some such configurations, such at that shown in FIG. 9, may apply compressive forces to the TSP body, particularly during use.

Specific mechanical configurations of TSP body 30 may be used when it is attached to base 70 mechanically through a hot press formation method, rather than via an infiltrant material.

In addition to or alternatively to mechanically enhancing the attachment of TSP body 30 the base 70, features of contact surface 100 may also increase the contact surface area in contact with matrix powder 40 before formation of super abrasive element 60, or in contact with base 70 after formation of super abrasive element 60. In particular, a non-planar contact surface 100 may increase the contact surface area. A larger contact surface area may improve bonding of TSP body 30 to base 70 by providing more pores adjacent the matrix powder 40 to be infiltrated by infiltrant material 50 or otherwise by increasing the surface wet by infiltrant material 50 during the formation process.

In some embodiments, the number or volume of pores at contact surface 100 may also help improve attachment of TSP body 30 to base 70 by providing more surface area for infiltrant material 50 to wet and attach to.

TSP body 30 may be any PCD leached sufficiently to be thermally stable. At temperatures suitable to allow infiltrant material 50 to infiltrate matrix powder 40 and to wet and infiltrate contact surface 100 or for some hot pressing techniques, remaining catalyst in PCD material that is not sufficiently leached will cause the material to graphitize to carbon, weakening it to the point where it is not suitable for use in a super abrasive element or possibly even causing it to disintegrate. Leaching of the TSP body may be performed prior to its placement in assembly 10 or 10*a* and prior to the formation of super abrasive element 60. TSP body 30 may be formed using standard techniques for creating a PCD layer. In particular, it may be formed by combining grains of natural or synthetic diamond crystal with a catalyst and subjecting the mixture to high temperature and pressure to form a PCD attached to or separate from any substrate. The PCD may contain a diamond body matrix and an interstitial matrix containing the catalyst. According to particular embodiments, the catalyst may include a Group VIII metal, particularly cobalt (Co).

The PCD may then be leached by any process able to remove the catalyst from the interstitial matrix. The leaching process may also remove the substrate, if any is present. In some embodiment, at least a portion of the substrate may be removed prior to leaching, for example by grinding. In particular embodiments, the PCD may be leached using an acid. The leaching process may differ from traditional leaching processes in that there is no need to protect any substrate or boundary regions from leaching. For example, it may be possible to simply place the PCD or PCD/substrate combination into an acid bath with none of the protective components typically employed. Even the design of the acid bath may differ from traditional acid baths. In many processes for use with the present disclosure a simple vat of acid may be used.

An alternative leaching method using a Lewis acid-based leaching agent may also be employed. In such a method, the PCD containing catalyst may be placed in the Lewis acid-based leaching agent until the desired amount of catalyst has been removed. This method may be conducted at lower temperature and pressure than traditional leaching methods. The Lewis acid-based leaching agent may include ferric chloride ($FeCl_3$), cupric chloride ($CuCl_2$), and optionally hydrochloric acid (HCl), or nitric acid ($HNO_3$), solutions thereof, and combinations thereof. An example of such a leaching method may be found in U.S. Ser. No. 13/168,733 by Ram Ladi et al., filed Jun. 24, 2011, and titled "CHEMICAL AGENTS FOR LEACHING POLYCRYSTALLINE DIAMOND ELEMENTS," incorporated by reference in its entirety herein.

When catalyst is removed from the interstitial matrix, pores are left where the catalyst used to be located. The percent leaching of a PCD may be characterized as the overall percentage of catalyst that has been removed to leave behind a pore. Although, as noted above, a gradient in the degree of leaching may be present from the surface of the PCD inwards, the average amount of leaching for a PCD may nevertheless be determined. According to specific embodiments of the current disclosure TSP body 30 may include a PCD which is substantially free of catalyst. More specifically, the TSP body may include a PCD from which at least 85%, at least 90%, at least 95%, or at least 99% of the catalyst has been leached on average.

In certain embodiments, TSP body 30 may have a uniform diamond grain size, but in other embodiments, the grain size may within the TSP body. For example, in some embodiments TSP body 30 may contain larger diamond grains near contact surface 100 in order to produce more pores, or larger volume pores, thereby providing more surface area to contact infiltrant material 50. In certain embodiments, these larger diamond grains may form an attachment layer (not shown) in TSP body 30. In other embodiments, diamond density may be less in an attachment layer. Difficulties in wetting diamond often pose a challenge in attaching TSP body 30 to base 70, so the lower diamond density may aid attachment by improving wetting of contact surface 100.

In still other embodiments, TSP body 30 may contain an attachment layer formed by a different material, such as a carbide former, particularly $W_2C$, or a material containing only low amounts of diamond as compared to the TSP body. In one embodiment, such an attachment layer may be placed on the TSP body prior for formation of the super abrasive element. Due to the destructive tendencies of leaching, such an attachment layer may be placed on TSP body 30 after it has been leached. In another embodiment, the attachment layer may be formed during super abrasive element formation by a separate material layer between matrix powder 40 and TSP body 30. In either embodiment, the attachment layer may be attached to the TSP body sufficiently to remain intact during use of the super abrasive element, but may offer improved attachment to base 70. For instance, the attachment layer may be more easily wet by infiltrant material 50, or may form a stronger attachment to infiltrant material 50 than TSP does.

Matrix powder 40 or 40*a* may be a powder or any other material suitable to form base 70 after infiltration with infiltrant material 50, which may function as a binder. In particular embodiments, matrix powder 40 or 40*a* may be a material commonly used to form substrates of conventional PCD elements. Matrix powder 40 or 40*a* may also provide beneficial properties to base 70, such as rigidity, erosion resistance, toughness, and each of attachment to TSP body 30. For example, it may be a carbide-containing or carbide-forming powder. Base 70 will typically have a higher content of infiltrant material 50 than conventional PCD element substrates have of similar materials. As a result, base 70 may be less erosion-resistant than conventional substrates. Certain powder blends may be used as matrix powder 40 to improve erosion resistance of base 70. In specific embodiments, powder blends may contain carbide, tungsten (W), tungsten carbide (WC or $W_2C$), synthetic diamond, natural diamond, chromium (Cr), iron (Fe), nickel (Ni), or other materials able to increase erosion resistance of base 70. Powder blends may also include copper (Cu), manganese (Mn), phosphorus (P), oxygen (O), zinc (Zn), tin (Sn), cadmium (Cd), lead (Pb), bismuth (Bi), or tellurium (Te). Matrix powder can contain any combinations or mixtures of the above-identified materials.

In some embodiments, matrix powder 40 or 40*a* may have a substantially uniform particle size. However, in other embodiments, particle size of matrix powder 40 or 40*a* may vary depending of the desired properties of base 70 or to facilitate attachment of base 70 to TSP body 30 either by infiltration or mechanical means. For example, infiltration methods such as those using assembly 10, a layer of matrix powder 40 with smaller particle size may be placed adjacent to TSP body 30. The smaller particle size may allow infiltrant material 50 to form a stronger attachment by allowing more infiltrant material 50 to reach contact surface 100. Typically particles of matrix powder 40 or 40*a* will be on a micrometer or nanometer scale. For example, average particle diameter may be greater than or equal to 5 μm, such as 5-6 μm. It may be much higher, such as 100 μm. These particle sized may represent the average diameter of particles found in a portion of base 70 extending half of the total length of base 70 from TSP body 30. Overall, particle size of matrix powder 40 or 40*a* may be substantially larger than permissible particle size in pre-formed substrates.

Although appropriate materials are commonly in a powder form, in some embodiments matrix powder 40 or 40*a* may be substituted with a non-powder material so long as the material is sufficient to be infiltrated with infiltrant material 50, form base 70, and substantially conform to contact surface 100 of TSP body 30.

Infiltrant material 50 may include any material able to infiltrate matrix powder 40 or 40*a* to form base 70. In hot press methods such as those using assembly 10*a*, infiltrant material 50 may be mixed with matrix powder 40*a* prior to hot pressing. In infiltration methods such as those using assembly 10, and potentially, but not necessarily also in some hot press methods, infiltrant material 50 may also to wet contact surface 100 and infiltrate at least a sufficient number of pores located at contact surface 100 of TSP body 30 to cause bonding of TSP body 30 to base 70 via infiltrant material 50. In particular embodiments, infiltrant material 50 may be a material having an affinity for diamond such that it readily wets contact surface 100 or is readily drawn into pores via capillary action or a similar attractive effect. In more specific embodiments, infiltrant material 50 may include a material suitable for use as a catalyst in PCD formation, such as a Group VIII metal, for example manganese (Mn) or chromium (Cr). Infiltrant material 50 may also be a carbide or material used in the formation of carbide, such as titanium (Ti) alloyed with copper (Cu) or silver (Ag). In certain embodiments, infiltrant material 50 may be a different material than was used as the catalyst during formation of the PCD later leached to form the TSP body. This allows easy detection of catalyst separate from binder. However, in other embodiments, the infiltrant material and catalyst may be the same.

In specific embodiments, infiltrant material 50 may be an alloy, such as a nickel (Ni) alloy or another metal alloy, such as a Group VIII metal alloy. Benefits in melt temperature may make alloys suitable as infiltrant materials, even when such alloys would not be suitable as catalyst materials in PCD formation.

After formation of super abrasive element 60, infiltrant material 50 may be found in base 70, where it may function as a binder. Infiltrant material 50 may also be found in TSP body 30 near contact surface 100 in filled pores. In some embodiments, infiltrant material 50 may be substantially confined to contact surface 100 and pores that open to that surface. However, in other embodiments, infiltrant material 50 may also enter pores near contact surface 100. The portion of TSP body 30 containing infiltrant material 50 may form the infiltrant material-containing region 80, while the remainder of the TSP body 30 substantially lacking binder may form infiltrant-free region 90. According to a specific embodiment, a depth, D to which infiltrant material 50 penetrates the TSP body 30 from contact surface 100 may on average be any depth sufficient to allow bonding of TSP body 30 to base 70. In particular embodiments it may be no more than 100 μm. In other particular embodiments, it may be no more than four grain sizes, no more than two grain sizes, no more than one grain size, no more than half a grain size, or no more than one quarter a grain size, in which grain size refers to the diamond grains at or near contact surface 100. In still other embodiments, infiltrant material 50 may only penetrate exposed pore space on contact surface 100.

Infiltrant material 50 may confer properties on TSP body 30 similar to properties conferred on a PCD by catalyst. In particular, infiltrant material 50 may decrease the abrasion resistance and thermal stability of regions of the TSP body in which it is found. In example embodiments, to minimize the negative effects of infiltrant material 50 on abrasion resistance and thermal stability, it may be advantageous to decrease or minimize the depth D of infiltrant material-containing region 80 to the amount sufficient to bond TSP body 30 to base 70.

Without limiting the bonding mechanism of infiltrant material 50, according to certain embodiments, the manner in which infiltrant material 50 bonds TSP body 30 to base 70 may include the formation of a physically continuous matrix of infiltrant material between TSP body 30 and base 70.

Matrix powder 40 or 40*a* may be formed into base 70 using any appropriate formation process. In particular embodiments, the formation process may provide one-step base formation and attachment, instead of requiring separate formation and attachment steps like some prior processes.

In one embodiment, the formation process may be a one-step infiltration process. In general, in such a process (and also in any hot press process also relying on infiltration of TSP body 30 by infiltrant material 50 to attach it to base 70), any material on contact surface 100 other than diamond may interfere with wetting and attachment by infiltrant material 50, so prior to incorporation in assembly 10, in certain embodiments, contact surface 100 of TSP body 30 may be cleaned. Assembly 10 may be assembled as described above and then placed in a furnace and heated to a temperature and for a time sufficient to cause infiltration of matrix powder 40 and TSP body 30 with infiltrant material 50 and casting of matrix powder 40 into base 70. Specifically, the furnace may be heated to a temperature at or above the infiltration temperature of infiltrant material 50. The minimum temperature able to allow infiltration of infiltrant material 50 may be referred to as the infiltration temperature. The time spent at or above the infiltration temperature may be the minimum amount required to allow infiltration of matrix powder 40 to form base 70 and attachment of base 70 to TSP body 30. In certain embodiments, the time spent at or above the infiltration temperature may be 60 seconds or less. In order to prevent oxidation reactions or contamination of infiltrant material 50 or matrix powder 40 during the formation process, the process make take place under vacuum or in the presence of an oxygen-free atmosphere, such as a reducing or inert atmosphere.

According to a specific embodiment, infiltrant material 50 may travel through matrix powder 40 due to attractive forces, such as capillary action. Upon reaching contact surface 100 of TSP body 30, infiltrant material 50 may wet the surface and bond to it. In particular embodiments, infiltrant material 50 enter open pores and fill them to form filled pores. Infiltrant material 50 may be drawn into pores via an attractive force, such as capillary action. This is particularly true if infiltrant material 50 is selected to have an affinity for diamond.

After heating, assembly 10 may be removed from the furnace and cooled to a temperature below the infiltration temperature. Cooling, in certain embodiments, may be carefully controlled in order to reduce or minimize any weakening of the attachment between base 70 and TSP body 30. For instance, it may be managed to reduce or minimize any residual stresses. Finally, super abrasive element 60 may be removed from mold 20.

According to another embodiment, assembly 10*a* may be used to form a superabrasive element 60 via a one-step hot press method. As noted above, in some embodiments forces generated by hot press methods may provide sufficient mechanical attachment of TSP body 30 to base 70 that attachment via the infiltration material is not required or is of minimal impact. In such embodiments, TSP body 30 may be shaped so as to facilitate such mechanical attachment. For instance, it may have a shape shown in FIGS. 4 and 5. In other embodiments, even when a hot press method is used, attachment of TSP body 30 to base 70 may partially or substantially rely on infiltration of TSP body 30 with infiltrant material 50. If such embodiments any material on contact surface 100 other than diamond may interfere with wetting and attachment by infiltrant material 50, such that prior to incorporation in assembly 10*a*, contact surface 100 of TSP body 30 may be cleaned.

After cleaning, if conducted, TSP body 30 may be loaded into hot press mold 20*a* then packed with matrix powder 40*a*, which may contain both a matrix material and an infiltration material or binder. The mold may then be closed and subjected to hot pressing at a temperature and pressure sufficient to melt the infiltrant material or binder and allow it to form substrate 70. In embodiments where infiltrant material infiltrates TSP body 30, the temperature and pressure may also be sufficient to allow this infiltration to occur. In certain embodiments, hot pressing may involve a cycle of changing temperature and pressure over time.

According to certain embodiments, hot pressing may be conducted under an inert or reducing atmosphere to prevent or reduce damage to TSP body 30. Alternatively, temperature may be carefully controlled to prevent oxidation of TSP body 30.

Hot pressing may be used to form a single super abrasive element 60 or multiple assemblies 10*a* may be processed as the same time to simultaneously form multiple super abrasive elements 60. In either case, each super abrasive element may be removed from mold 20*a* after completion of hot pressing.

In either infiltration process, the temperature and pressure used may be outside of the traditional diamond-stable region. The temperature and pressures at which PCD degrades to graphite are known in the art and described in the literature. For instance, the diamond-stable region may be determined through reference to Bundy et al. "Diamond-Graphite Equilibrium Line from Growth and Graphitization of Diamond," *J. of Chemical Physics,* 35(2):383-391 (1961), Kennedy and Kennedy, "the Equilibrium Boundary Between Graphite and Diamond," *J. of Geophysical Res.,* 81(14): 2467-2470 (1976), and Bundy, et al., "The Pressure-Temperature Phase and Transformation Diagram for Carbon; Updated through 1994," *Carbon* 34(2):141-153 (1996), each of which is incorporated by reference in material part herein. The highly stable nature of TSP may allow it to withstand temperature and pressures outside of the diamond-stable region for the time needed to form superabrasive element 60. For instance, at pressured used in infiltration processes, temperatures may reach as high as 1100° C. or 1200° C.

In general, if pressure is carefully controlled, an infiltrant with a higher melt temperature may be used, reducing the likelihood of infiltrant melting during downhole conditions or other harsh conditions.

Although use of temperatures and pressures outside of the diamond stable region is possible, in many embodiments, such as some hot press methods, temperatures and pressures may be within the diamond stable region. For example, some hot press techniques may employ temperatures of between 850° C.-900° C., particularly 870° C.

Figure 6:
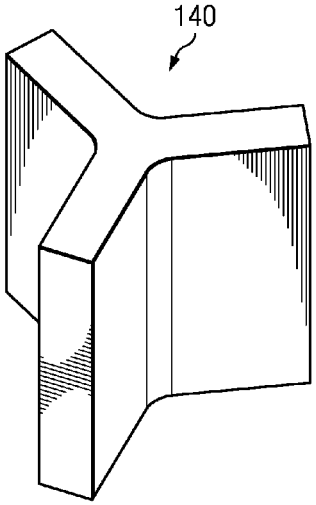
FIG. 6 is a side view of a carbide casting reinforcement for use in one embodiment of the present disclosure.

In addition to causing a decrease in erosion resistance as noted above, the presence of additional infiltrant material 50 in base 70 as compared to similar amounts of catalyst or binder in a conventional PCD element substrate causes base 70 to be less stiff than a conventional substrate. This may result in increased bending stresses on TSP body 30 when super abrasive element 60 is in use. In order to increase the stiffness of base 70, a carbide insert 140 as shown in FIG. 6 may be included in base 70. Carbide insert 140 may be formed of a binderless or near binderless carbide and may be resistant to infiltration by infiltrant material 50. Carbide insert 140 may be placed within matrix powder 40 in assembly 10. After formation of super abrasive element 60, carbide insert 140 may be present in base 70 in essentially the same configuration as it was placed in matrix powder 40. In addition to increasing the stiffness of base 70, carbide insert 140 may be exposed on the non-TSP body end of super abrasive element 60 after grinding and may then serve as an attachment point in a brazing process or a guide for rotation or placement of the super abrasive element. In an alternative embodiment, the insert may be formed for another suitable material other than carbide, such as a ceramic.

Super abrasive elements of the current disclosure may be in the form of any element that benefits from a TSP surface. In particular embodiments they may be cutters for earth-boring drill bits or components of industrial tools. Embodiments of the current disclosure also include tools containing super abrasive elements of the disclosure. Specific embodiments include industrial tools and earth-boring drill bits, such as fixed cutter drill bits. Other specific embodiments include wear elements, bearings, or nozzles for high pressure fluids.

Due to the ability to leach TSP body 30 more than a PCD layer may typically be leached when bound to a substrate, super abrasive elements of the current disclosure may be usable in conditions in which more elements with a traditional leached PCD layer are not. For instance, super abrasive elements may be used at higher temperatures than similar elements with a traditional leached PCD layer.

When super abrasive elements of the current disclosure are used as cutters on earth-boring drill bits, they may be used in place of any traditional leached PCD cutter. In many embodiments, they may be attached to the bits via base 70. For instance, base 70 may be attached to a cavity in the bit via brazing.

When used in cutting portions of a bit, the working surface of the cutter will wear more quickly than other portions of TSP body 30. When a circular cutter, such as that shown in FIG. 2 is used, the cutter may be rotated to move the worn TSP away from the working surface and to move unused TSP to the working surface. Circular cutters according to the present disclosure may be rotated in this fashion at least two times and often three times before they are too worn for further use. The methods of attachment and rotation may be any methods employed with traditional leached PCD cutters or other methods. Similarly, non-circular cutters may be indexable, allowing their movement to replace a worn working surface without replacing the entire cutter.

In embodiments using an insert with the shape shown in FIG. 6 or another suitable shape, the insert may be used as a guide for alignment of the working surface such that the working surface will receive additional support from the insert during use of the super abrasive element. For instance, when using an insert in the shape shown in FIG. 6, the element may be aligned such that its working surface is substantially along one of the insert arms and not in between the arms.

In addition to being rotatable, traditional PCD cutters may also be removed from a bit. This allows worn or broken cutters to be replaced or allows their replacement with different cutters more optimal for the rock formation being drilled. This ability to replace cutters greatly extends the usable life of the earth boring drill bit overall and allows it to be adapted for use in different rock formations. Cutters formed using super abrasive elements according to this disclosure may also be removed and replaced using any methods employed with traditional leached PCD cutters.

In certain other embodiments, super abrasive elements of the current disclosure may be used in directing fluid flow or for erosion control in an earth-boring drill bit. For instance, they may be used in the place of abrasive structures described in U.S. Pat. No. 7,730,976; U.S. Pat. No. 6,510,906; or U.S. Pat. No. 6,843,333, each incorporated by reference herein in material part.

Although only exemplary embodiments of the invention are specifically described above, it will be appreciated that modifications and variations of these examples are possible without departing from the spirit and intended scope of the invention. For example, although Super abrasive elements are discussed in detail other elements containing a similar component, such as leached cubic boron nitride, and similar method of forming such elements are also possible.

The invention claimed is:

1. A super abrasive element comprising:

a substantially catalyst-free thermally stable polycrystalline diamond (TSP) body having pores and a contact surface;

a base adjacent the contact surface of the TSP body; and a non-catalyst alloy infiltrant material dispersed within the base as a binder for a matrix powder from which the base is formed and in the pores of the TSP body at the contact surface, wherein the infiltrant material is infiltrated in the pores of the TSP body to a depth from the contact surface of 100 μm or less.

2. The super abrasive element according to claim 1, wherein the substantially catalyst-free TSP body comprises polycrystalline diamond (PCD) from which at least 85% of the catalyst has been removed to form the pores.

3. The super abrasive element according to claim 1, wherein the substantially catalyst-free thermally stable polycrystalline diamond TSP body comprises an acid-leached TSP body.

4. The super abrasive element according to claim 3, wherein the acid-leached TSP body comprises a $FeCl_3$-acid-leached TSP body.

5. The super abrasive element according to claim 1, wherein the contact surface is a non-planar surface.

6. The super abrasive element according to claim 1, wherein the base comprises a material selected from the group consisting of carbide, tungsten, tungsten carbide, synthetic diamond, natural diamond, or nickel, chromium, iron, copper, manganese, phosphorus, oxygen, zinc, tin, cadmium, lead, bismuth, tellurium, and any combinations thereof.

7. The super abrasive element according to claim 1, wherein super abrasive element further comprises a carbide insert disposed in the base.

8. The super abrasive element according to claim 1, wherein the non-catalyst alloy infiltrant material comprises a Group VIII metal alloy.

9. The super abrasive element according to claim 1, wherein the super abrasive element is in the form of a cutter for an earth-boring drill bit.

10. A super abrasive element comprising:

a substantially catalyst-free thermally stable polycrystalline diamond (TSP) body having pores, a contact surface, and diamond grains having an average grain size;

a base adjacent the contact surface of the TSP body; and an infiltrant material dispersed within the base as a binder for a matrix powder from which the base is formed and in the pores of the TSP body at the contact surface to a depth from the contact surface of 100 μm or less.

11. The super abrasive element according to claim 10, wherein the substantially catalyst-free TSP body comprises polycrystalline diamond (PCD) from which at least 85% of the catalyst has been removed to form the pores.

12. The super abrasive element according to claim 10, wherein the substantially catalyst-free thermally stable polycrystalline diamond TSP body comprises an acid-leached TSP body.

13. The super abrasive element according to claim 10, wherein the acid-leached TSP body comprises a $FeCl_3$-acid-leached TSP body.

14. The super abrasive element according to claim 10, wherein the contact surface is a non-planar surface.

15. The super abrasive element according to claim 10, wherein the base comprises a material selected from the group consisting of carbide, tungsten, tungsten carbide, synthetic diamond, natural diamond, or nickel, chromium, iron, copper, manganese, phosphorus, oxygen, zinc, tin, cadmium, lead, bismuth, tellurium, and any combinations thereof.

16. The super abrasive element according to claim 10, wherein super abrasive element further comprises a carbide insert disposed in the base.

17. The super abrasive element according to claim 10, wherein the infiltrant material comprises a Group VIII metal.

18. The super abrasive element according to claim 10, wherein the super abrasive element is in the form of a cutter for an earth-boring drill bit.

19. An earth-boring drill bit comprising a cutter, the cutter comprising a super abrasive element comprising:

a substantially catalyst-free thermally stable polycrystalline diamond (TSP) body having pores and a contact surface;

a base adjacent the contact surface of the TSP body; and a non-catalyst alloy infiltrant material dispersed within the base as a binder for a matrix powder from which the base is formed and in the pores of the TSP body at the contact surface, wherein the infiltrant material is infiltrated in the pores of the TSP body to a depth from the contact surface of 100 μm or less.

20. The earth-boring drill bit according to claim 19, wherein the substantially catalyst-free TSP body comprises polycrystalline diamond (PCD) from which at least 85% of the catalyst has been removed to form the pores.

21. The earth-boring drill bit according to claim 19, wherein the substantially catalyst-free thermally stable polycrystalline diamond TSP body comprises an acid-leached TSP body.

22. The earth-boring drill bit according to claim 21, wherein the acid-leached TSP body comprises a $FeCl_3$-acid-leached TSP body.

23. The earth-boring drill bit according to claim 19, wherein the contact surface is a non-planar surface.

24. The earth-boring drill bit according to claim 19, wherein the base comprises a material selected from the group consisting of carbide, tungsten, tungsten carbide, synthetic diamond, natural diamond, or nickel, chromium, iron, copper, manganese, phosphorus, oxygen, zinc, tin, cadmium, lead, bismuth, tellurium, and any combinations thereof.

25. The earth-boring drill bit according to claim 19, wherein super abrasive element further comprises a carbide insert disposed in the base.

26. The earth-boring drill bit according to claim 19, wherein the non-catalyst alloy infiltrant material comprises a Group VIII metal alloy.

27. The earth-boring drill bit according to claim 19, wherein the bit is fixed-cutter drill bit.

28. The earth-boring drill bit according to claim 19, wherein the cutter comprises a rotatable and replaceable cutter.

29. An earth-boring drill bit comprising a cutter, the cutter comprising a super abrasive element comprising:

a substantially catalyst-free thermally stable polycrystalline diamond (TSP) body having pores, a contact surface, and diamond grains having an average grain size;

a base adjacent the contact surface of the TSP body; and an infiltrant material dispersed within the base as a binder for a matrix powder from which the base is formed and in the pores of the TSP body at the contact surface to a depth from the contact surface of 100 μm or less.

30. The earth-boring drill bit according to claim 29, wherein the substantially catalyst-free TSP body comprises polycrystalline diamond (PCD) from which at least 85% of the catalyst has been removed to form the pores.

31. The earth-boring drill bit according to claim 29, wherein the substantially catalyst-free thermally stable polycrystalline diamond TSP body comprises an acid-leached TSP body.

32. The earth-boring drill bit according to claim 29, wherein the acid-leached TSP body comprises a $FeCl_3$-acid-leached TSP body.

33. The earth-boring drill bit according to claim 29, wherein the contact surface is a non-planar surface.

34. The earth-boring drill bit according to claim 29, wherein the base comprises a material selected from the group consisting of carbide, tungsten, tungsten carbide, synthetic diamond, natural diamond, or nickel, chromium, iron, copper, manganese, phosphorus, oxygen, zinc, tin, cadmium, lead, bismuth, tellurium, and any combinations thereof.

35. The earth-boring drill bit according to claim 29, wherein super abrasive element further comprises a carbide insert disposed in the base.

36. The earth-boring drill bit according to claim 29, wherein the infiltrant material comprises a Group VIII metal.

37. The earth-boring drill bit according to claim 29, wherein the bit is fixed-cutter drill bit.

38. The earth-boring drill bit according to claim 29, wherein the cutter comprises a rotatable and replaceable cutter.

* * * * *